US010036988B2

(12) United States Patent
Kuroiwa

(10) Patent No.: US 10,036,988 B2
(45) Date of Patent: Jul. 31, 2018

(54) IMAGE FORMING APPARATUS HAVING DEFORMED ROLLER DETERMINATION

(71) Applicant: CANON FINETECH NISCA INC., Misato-shi, Saitama-ken (JP)

(72) Inventor: Ikuyo Kuroiwa, Yoshikawa (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 0 days.

(21) Appl. No.: 14/013,410

(22) Filed: Aug. 29, 2013

(65) Prior Publication Data

US 2014/0064751 A1 Mar. 6, 2014

(30) Foreign Application Priority Data

Aug. 31, 2012 (JP) ..... 2012-190748
Oct. 30, 2012 (JP) ..... 2012-239187
(Continued)

(51) Int. Cl.
*G03G 15/00* (2006.01)
*G03G 15/02* (2006.01)

(52) U.S. Cl.
CPC ..... *G03G 15/55* (2013.01); *G03G 15/0208* (2013.01); *G03G 15/553* (2013.01)

(58) Field of Classification Search
CPC ..... G03G 15/02; G03G 15/0208; G03G 15/0216; G03G 15/55; G03G 15/553;
(Continued)

(56) References Cited

U.S. PATENT DOCUMENTS 7,903,989 B2 3/2011 Tanaka
8,447,197 B2 5/2013 Yamazaki
(Continued)

FOREIGN PATENT DOCUMENTS

JP H06-035292 A 2/1994
JP H08-160813 A 6/1996
(Continued)

OTHER PUBLICATIONS

Korean Office Action dated Oct. 7, 2015, in Korean Patent Application No. KR 10-2013-0103930.
(Continued)

*Primary Examiner* — David M Gray
*Assistant Examiner* — Laura Roth
(74) *Attorney, Agent, or Firm* — Fitzpatrick, Cella, Harper & Scinto

(57) ABSTRACT

An image forming apparatus includes a rotatable roller member held in press-contact with an image bearing member, and a deformation determining unit that determines deformation of the roller member based on a value of a current flowing between the roller member and the image bearing member in response to application of a voltage to the roller member. The deformation determining unit performing detection of the deformation of the roller member in response to a predetermined indication before start of an image forming operation. In addition, a restoring unit restores deformation of the roller member based on a detection result of the deformation determining unit.

15 Claims, 12 Drawing Sheets

(30) Foreign Application Priority Data

May 31, 2013 (JP) ..... 2013-115607
Aug. 23, 2013 (JP) ..... 2013-173737

(58) Field of Classification Search
CPC ..... G03G 15/50; G03G 15/5054; G03G 15/5008; G03G 15/5033; G03G 15/5045; G03G 15/80; G03G 21/20
See application file for complete search history.

(56) References Cited

U.S. PATENT DOCUMENTS

2002/0021917 A1* 2/2002 Ishiyama ..... G03G 15/0233 399/175
2003/0053809 A1* 3/2003 Ogata ..... G03G 15/553 399/12
2004/0013448 A1 1/2004 Lee
2004/0114947 A1* 6/2004 Geleynse ..... G03G 15/55 399/31
2005/0084274 A1* 4/2005 Yoshida ..... G03G 15/5054 399/44
2008/0122460 A1* 5/2008 Ichikawa ..... G01B 7/06 324/699
2009/0262173 A1* 10/2009 Hagiwara ..... B41J 13/08 347/104
2010/0329710 A1 12/2010 Yamazaki
2014/0003828 A1* 1/2014 Araki ..... G03G 15/0266 399/50

FOREIGN PATENT DOCUMENTS

JP H09-179385 A 7/1997
JP 2001-117442 A 4/2001
JP 2002-333812 A 11/2002
JP 2004-045572 A 2/2004
JP 2004045572 A * 2/2004
JP 2004-101838 A 4/2004
JP 2005-338700 * 12/2005
JP 2006-227535 * 8/2006
JP 2006-227535 A 8/2006
JP 2006227535 A * 8/2006
JP 2007-240595 * 9/2007 ..... G03G 15/08
JP 2009-063894 A 3/2009
JP 2009075356 A * 4/2009 ..... G03G 15/6564
JP 2009-251301 A 10/2009
JP 2011-028226 A 2/2011
JP 2011028226 A * 2/2011

OTHER PUBLICATIONS

Chinese Office Action dated Dec. 16, 2015, in Chinese Patent Application No. 201310385853.7 (with English translation).

Korean Office Action dated Jul. 22, 2016, in Korean Patent Application No. 10-2013-0103930.

* cited by examiner

FIG. 4

| TEMPERATURE AND HUMIDITY ENVIRONMENT | ABSOLUTE MOISTURE AMOUNT MORE THAN 16kg/kg.D.A | 15°C OR MORE AND LESS THAN 20°C/ ABSOLUTE MOISTURE AMOUNT 10kg/kg.D.A OR MORE AND LESS THAN 16kg/kg.D.A | 10°C OR MORE AND LESS THAN 15°C/ ABSOLUTE MOISTURE AMOUNT LESS THAN 10kg/kg.D.A | 5°C OR MORE AND LESS THAN 10°C | LESS THAN 5°C |
|---|---|---|---|---|---|
| HIGH VOLTAGE OUTPUT DURING PRINTING | 1.5kV | 1.6kV | 1.7kV | 1.9kV | 2.2kV |
| HIGH VOLTAGE OUTPUT DURING DETECTING | 1.1kV | 1.2kV | 1.3kV | 1.4kV | 1.5kV |

FIG. 7

| TEMPERATURE (°C) | T1 | | | | | | | | T2 | | | | | | | |
|---|---|---|---|---|---|---|---|---|---|---|---|---|---|---|---|---|
| HUMIDITY (%) | W1 | | | | W2 | | | | W1 | | | | W2 | | | |
| LEFT TIME PERIOD (h) | t1 | | t2 | | t1 | | t2 | | t1 | | t2 | | t1 | | t2 | |
| RESISTANCE (Ω) | R1 | R2 | R1 | R2 | R1 | R2 | R1 | R2 | R1 | R2 | R1 | R2 | R1 | R2 | R1 | R2 |
| DEFORMATION LEVEL | RESTORING OPERATION IS UNNECESSARY | | | | | | A | B | RESTORING OPERATION IS UNNECESSARY | | A | B | | | C | |

(T1 > T2)
(W1 > W2)
(t1 < t2)
(R1 < R2)

| TEMPERATURE | 25°C OR MORE | | | | | LESS THAN 25°C | | | | | |
|---|---|---|---|---|---|---|---|---|---|---|---|
| HUMIDITY | 50% OR MORE | | LESS THAN 50% | | | 50% OR MORE | | | LESS THAN 50% | | |
| LEFT TIME PERIOD | LESS THAN 24h | 24h OR MORE | LESS THAN 24h | 24h OR MORE | | LESS THAN 24h | 24h OR MORE | | LESS THAN 24h | | 24h OR MORE |
| ROLLER RESISTANCE (CALCULATED FROM FEEDBACK CURRENT AMOUNT) | - | - | - | LESS THAN $5.0 \times 10^5$ (Ω) | $5.0 \times 10^5$ (Ω) OR MORE | - | LESS THAN $5.0 \times 10^5$ (Ω) | $5.0 \times 10^5$ (Ω) OR MORE | LESS THAN $5.0 \times 10^5$ (Ω) | $5.0 \times 10^5$ (Ω) OR MORE | - |
| DEFORMATION LEVEL | RESTORING OPERATION IS UNNECESSARY | RESTORING OPERATION IS UNNECESSARY | RESTORING OPERATION IS UNNECESSARY | A | B | RESTORING OPERATION IS UNNECESSARY | A | B | B | C | C |
| RESTORING LEVEL | UNNECESSARY | UNNECESSARY | UNNECESSARY | A | B | UNNECESSARY | A | B | B | C | C |

FIG. 9

| TEMPERATURE | 25°C OR MORE | 15°C OR MORE AND LESS THAN 25°C | 25°C OR MORE | | | |
|---|---|---|---|---|---|---|
| HUMIDITY | 50% OR MORE | | LESS THAN 50% | | | |
| LEFT TIME PERIOD | - | | LESS THAN 24h | 24h OR MORE AND LESS THAN 48h | 48h OR MORE | |
| ROLLER RESISTANCE (CALCULATED FROM FEEDBACK CURRENT AMOUNT) | - | | - | - | LESS THAN $5.0 \times 10^5$ (Ω) | $5.0 \times 10^5$ (Ω) OR MORE |
| DEFORMATION LEVEL | RESTORING OPERATION IS UNNECESSARY | RESTORING OPERATION IS UNNECESSARY | RESTORING OPERATION IS UNNECESSARY | A | A | B |
| RESTORING LEVEL | UNNECESSARY | UNNECESSARY | UNNECESSARY | A | A | B |

FIG. 10A

| TEMPERATURE | 15°C OR MORE AND LESS THAN 25°C | | | | | 0°C OR MORE AND LESS THAN 15°C | |
|---|---|---|---|---|---|---|---|
| HUMIDITY | LESS THAN 50% | | | | | 50% OR MORE | LESS THAN 50% |
| LEFT TIME PERIOD | LESS THAN 24h | 24h OR MORE AND LESS THAN 48h | | 48h OR MORE | | 24h OR MORE | |
| ROLLER RESISTANCE (CALCULATED FROM FEEDBACK CURRENT AMOUNT) | - | LESS THAN $5.0 \times 10^5$ (Ω) | $5.0 \times 10^5$ (Ω) OR MORE | LESS THAN $5.0 \times 10^5$ (Ω) | $5.0 \times 10^5$ (Ω) OR MORE | - | |
| DEFORMATION LEVEL | A | A | B | B | C | B | C |
| RESTORING LEVEL | A | A | B | B | C | B | C |

FIG. 10B

| TEMPERATURE | 25°C OR MORE | | | | |
|---|---|---|---|---|---|
| HUMIDITY | 50% OR MORE | | LESS THAN 50% | | |
| LEFT TIME PERIOD | LESS THAN 24h | 24h OR MORE | LESS THAN 24h | 24h OR MORE | |
| ENDURANCE NUMBER OF SHEETS | - | - | - | LESS THAN 30,000 SHEETS | 30,000 SHEETS OR MORE |
| DEFORMATION LEVEL | RESTORING OPERATION IS UNNECESSARY | RESTORING OPERATION IS UNNECESSARY | RESTORING OPERATION IS UNNECESSARY | A | B |
| RESTORING LEVEL | UNNECESSARY | UNNECESSARY | UNNECESSARY | A | B |

| LESS THAN 25°C | | | | | |
|---|---|---|---|---|---|
| 50% OR MORE | | | LESS THAN 50% | | |
| LESS THAN 24h | 24h OR MORE | | LESS THAN 24h | | 24h OR MORE |
| - | LESS THAN 30,000 SHEETS | 30,000 SHEETS OR MORE | LESS THAN 30,000 SHEETS | 30,000 SHEETS OR MORE | - |
| RESTORING OPERATION IS UNNECESSARY | A | B | B | C | C |
| UNNECESSARY | A | B | B | C | C |

FIG. 11

IMAGE FORMING APPARATUS HAVING DEFORMED ROLLER DETERMINATION

BACKGROUND OF THE INVENTION

Field of the Invention

The present invention relates to an electrophotographic image forming apparatus configured to form an image by transferring a toner image formed on an image bearing member onto a sheet.

Description of the Related Art

In an electrophotographic image forming apparatus, an image is formed as follows. A photosensitive drum serving as an image bearing member is charged and exposed with light to form an electrostatic image. The electrostatic image is developed by toner, and the developed image is transferred onto a sheet at a transfer portion. In this image forming apparatus, as a method of charging the photosensitive drum, there is used a contact charging method of applying a charging voltage to a charging roller that is rotated in association with the photosensitive drum while being held in press-contact therewith. At the transfer portion for transferring the toner image, there is generally used a configuration in which a transfer voltage is applied to a transfer roller that is rotated in association with the photosensitive drum while being held in press-contact therewith.

As the charging roller and the transfer roller to be brought into press-contact with the photosensitive drum, an elastic roller including an elastic layer around a shaft core is used. When the elastic roller is left without being rotated for a long period of time under a state in which the elastic roller is held in press-contact with the photosensitive drum, the elastic roller may undergo a press-contact deformation. When the elastic layer of the elastic roller is held in press-contact for only a short period of time, the elastic layer is restored to its original shape after the press-contact is released. However, when the elastic layer is continuously pressed, the deformation progresses. Further, the deformation may be fixed to prevent the elastic layer from restoring to its original shape.

Therefore, there is known a method of detecting the press-contact deformation of the roller member and performing a restoring operation when the roller member is deformed. For example, as a configuration of detecting the press-contact deformation of the charging roller, there has been proposed a technology of forming a toner patch image on the photosensitive drum and reading, by a sensor, a minimal density change of the patch image in a drum rotating direction (sub-scanning direction), to thereby detect the press-contact deformation based on the density change appearing at the deformed part of the charging roller (Japanese Patent Application Laid-Open No. 2011-28226).

As a method of restoring the press-contact deformation of the roller member, there has been proposed a method of restoring the roller member by repeatedly idly rotating the deformed roller member under a state in which the deformed roller member is held in press-contact with another member (Japanese Patent Application Laid-Open No. 2006-227535).

In the configuration that uses the patch image to detect the press-contact deformation of the roller member, the roller deformation is determined based on the density change of the patch image formed on the photosensitive drum, and hence the detection is not accurate in some cases.

In the configuration in which the roller member is idly rotated to restore the press-contact deformation of the roller member, the idling time needs to be extended in a case of restoring the deformation of a roller member that has been left for a long period of time, and thus it takes a long time to restore the press-contact deformation. Moreover, the deformation may not completely recover with a single processing merely including idle rotation.

SUMMARY OF THE INVENTION

The present invention has been made in view of the above-mentioned points, and provides an image forming apparatus capable of accurately detecting deformation of a roller member.

The present invention provides an image forming apparatus capable of accurately restoring the deformed roller member.

According to an exemplary embodiment of the present invention, there is provided an image forming apparatus configured to form an image by forming an electrostatic latent image on an image bearing member and developing the electrostatic latent image by a developer, the image forming apparatus including: a rotatable roller member configured to be held in press-contact with the image bearing member; and a deformation determining unit configured to determine deformation of the roller member, and the deformation determining unit configured to determine the deformation of the roller member based on a value of a current flowing between the roller member and the image bearing member in response to application of a voltage to the rotating roller member.

According to another exemplary embodiment of the present invention, there is provided an image forming apparatus configured to form an image by forming an electrostatic latent image on an image bearing member and developing the electrostatic latent image by a developer, the image forming apparatus including: a rotatable roller member configured to be held in press-contact with the image bearing member; and a deformation determining unit configured to determine deformation of the roller member, and the deformation determining unit configured to determine a deformation level of the roller member based on at least one of a time period in which the roller member is left in a rotation stop state, an environment in which the roller member is left in the rotation stop state, a number of sheets subjected to recording on each of which an image is formed by the image bearing member with use of the roller member, and a resistance value of the roller member.

According to another exemplary embodiment of the present invention, there is provided an image forming apparatus configured to form an image by forming an electrostatic latent image on an image bearing member and developing the electrostatic latent image by a developer, the image forming apparatus including: a rotatable roller member configured to be held in press-contact with the image bearing member; and a restoring unit configured to restore deformation of the roller member, and the restoring unit configured to apply an AC voltage to the roller member when not forming the image.

According to another exemplary embodiment of the present invention, there is provided an image forming apparatus configured to form an image by forming an electrostatic latent image on an image bearing member and developing the electrostatic latent image by a developer, the image forming apparatus including: a rotatable roller member configured to be held in press-contact with the image bearing member; and a restoring unit configured to restore deformation of the roller member, and the restoring unit configured to perform different restoring according to the deformation of the roller member.

According to the embodiments of the present invention, the deformation of the roller member held in press-contact with the image bearing member is detected by the value of the current flowing between the roller member and the image bearing member, and hence the deformation of the roller member may be accurately detected without forming a patch image or the like.

In order to restore the deformed roller member, the roller member is rotated and an AC voltage is applied thereto. In this manner, micro vibration occurs in the rotating roller member, and thus restoring of the deformation of the roller member including an elastic member can be promoted.

Further features of the present invention will become apparent from the following description of exemplary embodiments with reference to the attached drawings.

BRIEF DESCRIPTION OF THE DRAWINGS

FIG. 4 is a table illustrating detection voltage values to be changed depending on an apparatus environment.

FIG. 7 is a table determining the press-contact deformation of the roller.

FIG. 9 is a deformation level determination table used in Experiment 1 according to the second embodiment.

FIGS. 10A and 10B are deformation level determination tables used in Experiment 2 according to the second embodiment.

FIG. 11 is a deformation level determination table used in Experiment 3 according to the second embodiment.

DESCRIPTION OF THE EMBODIMENTS

Now, an image forming apparatus according to each embodiment of the present invention is described with reference to the drawings.

First Embodiment

<Overall Configuration of Image Forming Apparatus>

Figure 1:
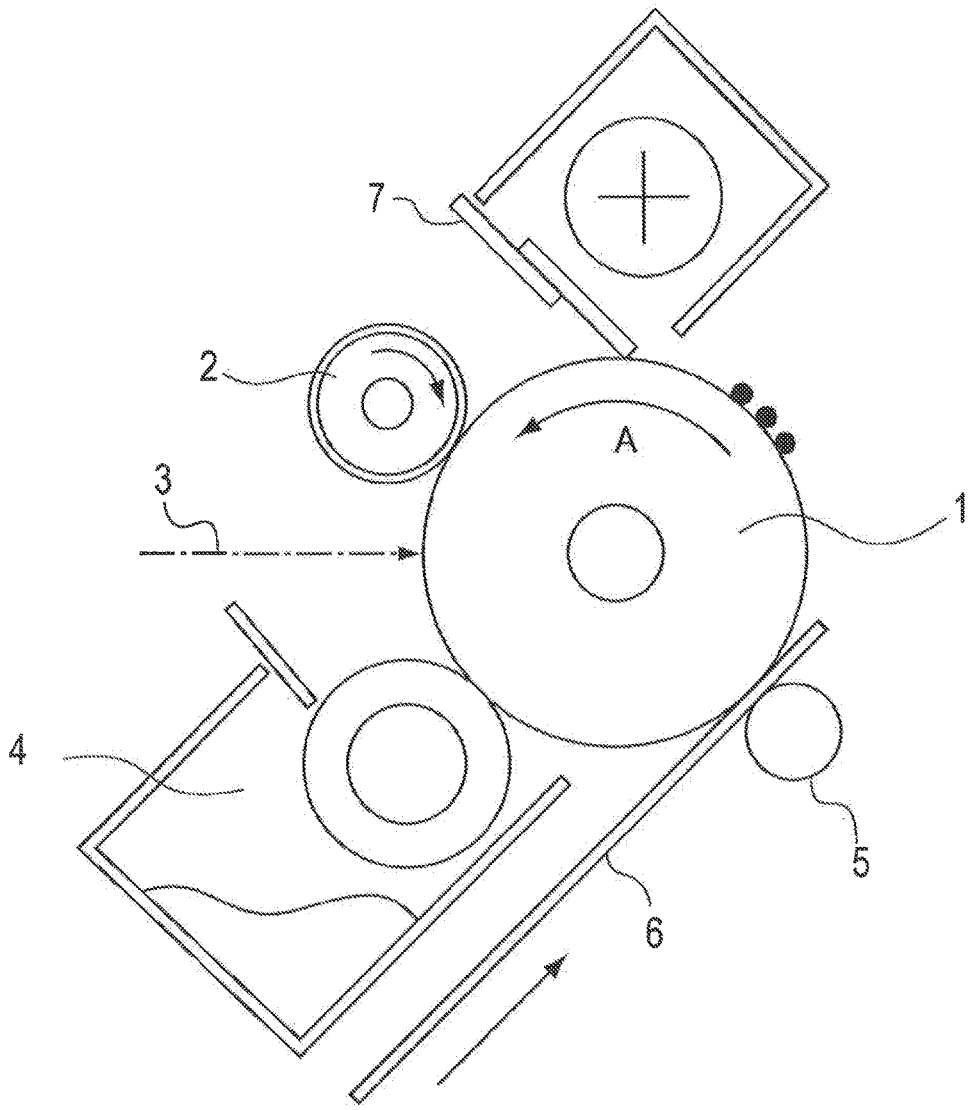
FIG. 1 is a schematic sectional view of an image forming portion of an image forming apparatus.

FIG. 1 is a schematic explanatory sectional view illustrating an image forming portion of an image forming apparatus according to this embodiment. The image forming apparatus according to this embodiment is used as an electrophotographic copying machine, printer, etc.

An overall configuration of an image forming apparatus of this embodiment is described together with the image forming operation. When forming an image, to a surface of a photosensitive drum 1 serving as an image bearing member that rotates in an arrow direction A of FIG. 1, a charging voltage is applied by a charging roller 2, and thus the surface of the photosensitive drum 1 is uniformly charged. The photosensitive drum 1 is irradiated with a laser beam 3 emitted from an exposure unit (not shown) in accordance with an image signal, and thus an electrostatic latent image is formed on the photosensitive drum 1. The electrostatic latent image is developed with a developer by a developing device 4 to form a toner image.

In synchronization with the formation of the toner image, a recording medium is conveyed to a transfer portion by a conveyance unit (not shown). The transfer portion includes a nip portion formed between the photosensitive drum 1 and a transfer roller 5. When a recording medium (a sheet) 6 is conveyed to the nip portion, a transfer voltage is applied to the transfer roller 5 so that the toner image formed on the photosensitive drum 1 is transferred onto the recording medium 6. The recording medium 6 having the toner image transferred thereon is conveyed to a fixing device (not shown). The recording medium 6 is heated and pressurized to fix the toner image onto the recording medium, and then the recording medium is delivered to a delivery portion (not shown).

Not all of the toner on the photosensitive drum 1 is transferred onto the recording medium 6 at the transfer portion, and minute toner remains on the photosensitive drum 1. The residual toner is removed and collected by a cleaning device 7, and a subsequent toner image is formed on the photosensitive drum 1.

<Charging Roller>

The charging roller 2 of this embodiment is a multilayered elastic roller including a conductive shaft, a conductive elastic-body base layer formed on the outer periphery of the shaft, and a surface layer covering the outer periphery of the conductive elastic-body base layer. The charging roller 2 is provided in press-contact with the photosensitive drum 1 and in a rotatable manner.

The conductive elastic body is polar cross-linked rubber whose hardness in Asker C hardness is preferably 55° or less, particularly preferably 50° or less. When the hardness exceeds 55° in Asker C hardness, the nip width between the charging roller 2 and the photosensitive drum 1 reduces. As a result, the abutment force between the charging roller 2 and the photosensitive drum 1 concentrates in a narrow area, and thus the abutment pressure increases. This causes significant negative effects such as reduction in charge injection amount in a nip region which may cause unstable charging, and scattering of undeveloped toner which may cause easy adhesion of toner or the like on the surfaces of the photosensitive drum 1 or the charging roller 2.

The "Asker C hardness" herein refers to hardness of a roller, which is measured with an ASKER-C type spring-type rubber hardness meter (manufactured by KOBUNSHI KEIKI CO., LTD.) according to the Standard SRIS0101 of the Society of Rubber Science and Technology, Japan. The hardness is a value measured 30 seconds after the hardness meter is brought into abutment at a force of 10 N with a roller that has been left for 12 hours or more in an environment of normal temperature and normal humidity (23° C., 55% RH).

<Deformation Determining Unit for Charging Roller>

In a contact-type roller charging method in which the elastic roller is rotated while being held in press-contact with the photosensitive drum 1, when the elastic roller is left for a long period of time in a stop state without performing the image forming operation, the part subjected to press-contact is recessed, that is, so-called press-contact deformation occurs. When an image is formed with use of a charging roller that has undergone press-contact deformation, the charging property in the deformed region changes. Therefore, there occurs such a trouble that horizontal streaks and unevenness are generated in the image at a pitch of the outer periphery of the charging roller. In this embodiment, the image forming apparatus is controlled as follows. The press-contact deformation of the charging roller 2 is detected, and then an operation of restoring the deformation is executed based on the detection results.

In this embodiment, the press-contact deformation of the charging roller 2 is detected based on the value of a feedback current flowing between the charging roller 2 and the photosensitive drum 1 when a voltage is applied to the charging roller 2.

Setting is made so that the press-contact deformation determination is performed when the power is turned ON, when the apparatus is resumed from sleep, and when an operation of rotating the photosensitive drum 1 is performed after an operation of opening or closing the door is performed. At this time, it is not preferred to apply an excessive voltage to the photosensitive drum 1, when considering the damage on the photosensitive drum 1. In view of this, it is preferred that a voltage value applied as a detection voltage is set smaller than a setting value for image formation, and that the voltage value may be limited to a minimum range in which a feedback current amount for determining the deformation amount of the charging roller can be obtained. For example, the detection voltage value is set to a value of about 70% of a value of a voltage to be applied to the charging roller during normal image formation.

The detection voltage to be applied to the charging roller 2 when detecting the press-contact deformation may be merely a DC voltage, merely an AC voltage, or a voltage obtained by superimposing a DC voltage and an AC voltage. In an apparatus that can select the DC voltage or the AC voltage and apply the selected voltage, any one of the voltages is applied as a detection voltage to enable setting of a small detection voltage. When the DC voltage and the AC voltage are superimposed with each other and the superimposed voltage is applied, it becomes possible to detect the press-contact deformation of the charging roller 2 with high accuracy even when the detection voltage value increases due to the superimposing.

The amount of a current flowing between the charging roller 2 and the photosensitive drum 1 changes depending on the environment, and hence the voltage value to be applied during the press-contact deformation determination may be changed in accordance with temperature and humidity information detected by an environment sensor arranged inside the image forming apparatus. As for the voltage application time period, in order to compare the periodicity of the charging roller 2 to the detection current value, it is necessary to detect a feedback current value during a time period in which the charging roller 2 rotates at least one revolution, preferably three revolutions.

For example, in a high temperature and high humidity environment, the charging roller 2 contains a larger amount of moisture, and hence the electric resistance value decreases. Therefore, when the same detection voltage as that used in a normal temperature and normal humidity environment is applied, a large detection current flows. In view of this, in a high temperature and high humidity environment, the detection voltage value is set smaller than that used in a normal temperature and normal humidity environment. In a low temperature and low humidity environment, the charging roller 2 contains a smaller amount of moisture, and hence the relationship is reversed from the case of the high temperature and high humidity environment, that is, when the same detection voltage as that used in a normal temperature and normal humidity environment is applied, the detection current decreases. Therefore, in a low temperature and low humidity environment, the detection voltage value is set larger than that used in a normal temperature and normal humidity environment.

The press-contact deformation of the charging roller 2 causes density change such as generation of horizontal streaks and unevenness in an image because a potential difference is generated on the surface of the photosensitive drum. This is because the charging roller 2 rotating in contact with the photosensitive drum 1 changes its contact state in the part that has undergone press-contact deformation, and hence the discharge amount changes in this part to appear as a change in current amount. In view of this, there is provided a unit configured to detect the feedback current value obtained by feeding back the amount of a current flowing between the charging roller 2 and the photosensitive drum 1. Based on the feedback current value, the pitch property of the outer periphery of the charging roller, that is, the deformation position and the deformation level are detected.

Figure 2:
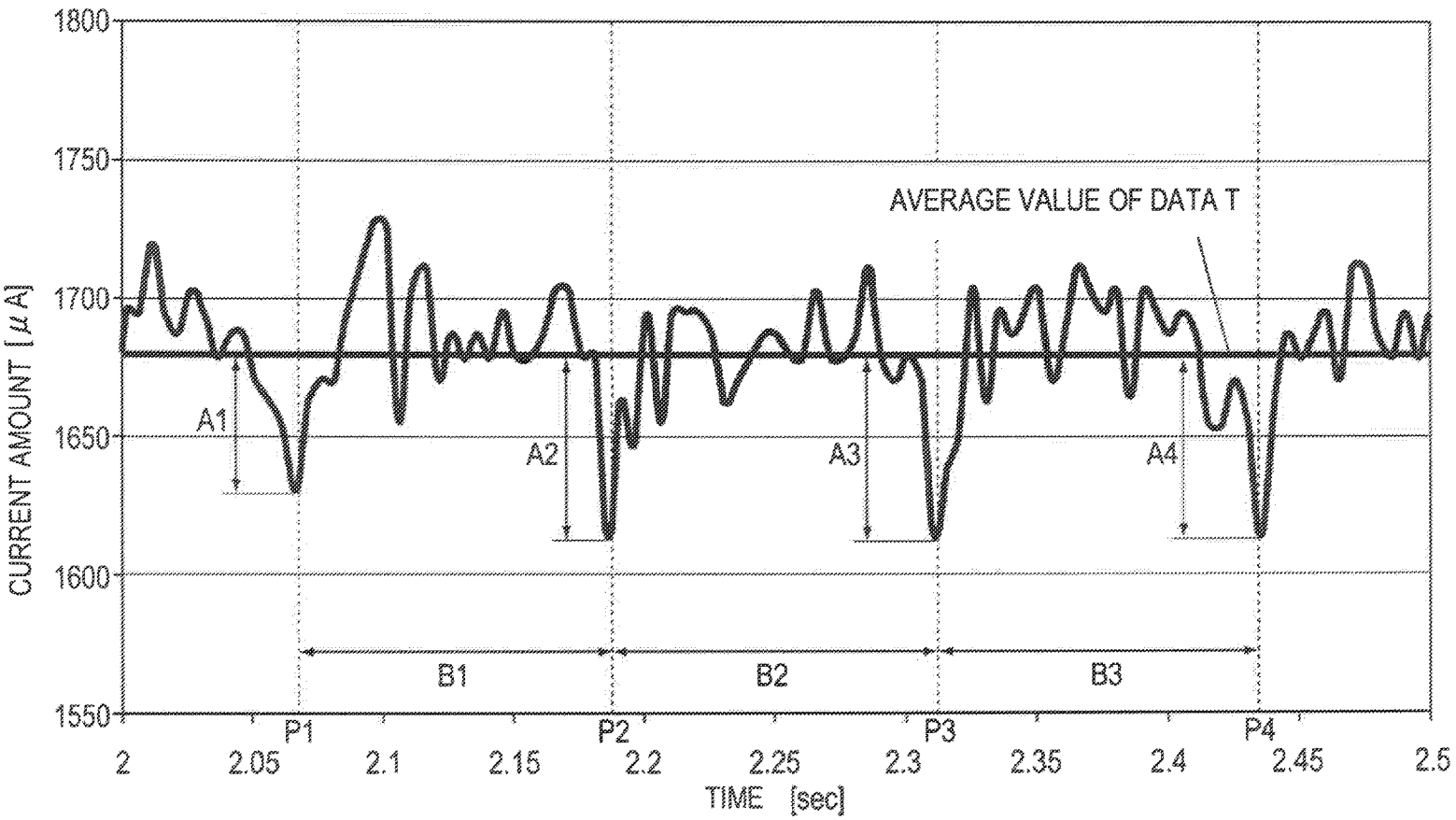
FIG. 2 is a graph showing a change in feedback current amount when press-contact deformation is generated in a roller.

FIG. 2 illustrates change in feedback current flowing between the charging roller 2 and the photosensitive drum 1 during rotation of the photosensitive drum 1 and application of the charging voltage by using the charging roller 2 that has undergone press-contact deformation. T in FIG. 2 represents an average value of feedback current data collected during the detection operation. The roller deformation is detected by calculating the difference between each feedback current value and the average value T to determine the level of roller deformation based on the difference level. For example, at positions P1, P2, P3, and P4 of FIG. 2, differences A1, A2, A3, and A4 are significantly changed, and the feedback current is outstandingly large at those positions. Therefore, it is possible to determine that the charging roller 2 is deformed at a position corresponding to those positions. In a case where intervals B1, B2, and B3 between the positions P1, P2, P3, and P4, at which the feedback current value significantly changes, match with the pitch of the outer periphery of the rotating charging roller 2, it is possible to determine that the press-contact deformation is generated in this part of the charging roller 2. At this point, in a case where the interval B of the pitch of the outer periphery is continuously generated more than two times, it is determined that the press-contact deformation is generated. It is because that, in a case where the interval is not continuously generated, it is thought to be aftereffects of electrical noise.

The deformation level of the charging roller 2 can be determined based on the magnitude of difference A (A1, A2, A3, and A4). Difference A becomes smaller as the deformation amount of the charging roller 2 becomes smaller, and larger as the deformation amount becomes larger. For example, when difference A falls within a range of 50 $\mu A \leq A < 70\ \mu A$, the deformation amount is defined as level 1, when difference A falls within a range of 70 $\mu A \leq A < 100\ \mu A$, the deformation amount is defined as level 2 representing a larger deformation amount than that in level 1, and when difference A falls within a range of 100 $\mu A \leq 150\ \mu A$, the deformation amount is defined as level 3 representing a larger deformation amount than that in level 2. That is, when the feedback current value detected with a period of an outer periphery pitch in accordance with the rotation of the charging roller 2 falls within a predetermined range set in advance, the deformation of the charging roller 2 is detected, and a plurality of levels are set for the deformation to thereby determine the level of the roller deformation.

It is determined that the charging roller 2 is deformed when difference A falls within the predetermined range. The predetermined range depends on the characteristics of the charging roller and the accuracy of the detection circuit, and hence the predetermined range may be arbitrarily set. It is preferred that a range of 30 μA to 300 μA, preferably a range of 50 μA to 200 μA, may be divided so as to set at least two or three stages of deformation levels at an interval of 50 μA to 100 μA. When it is detected that there is the deformation of the roller in a case where difference A is 50 μA or less, the noise peak during detection may be falsely detected as a current amount peak caused by the roller deformation. On the other hand, when it is detected that there is the deformation of the roller in a case where difference A is 300 μA or more, the current amount peak caused by the roller deformation is not detected accurately.

When the roller deformation is determined based on the feedback current value, setting of the number of data items (sampling rate) to be used for detection becomes important. In order to certainly detect the pitch property of the outer periphery of the deformed roller member, the sampling rate is set finer, which leads to higher accuracy. It is desired that the sampling rate be set so that the current value is detected at least at such intervals that the nip width between the photosensitive drum 1 and the charging roller 2 rotating in press-contact is divided into two to five parts. The total time period for collecting the detection data is desired to be arbitrarily set to a time period in which the charging roller 2 rotates at least a plurality of revolutions, for example, two to five revolutions.

When the detection data is collected, the rotating speed of the charging roller 2 is set slower than the rotating speed of the charging roller during normal image formation. The sampling rate per distance becomes finer, and hence the number of detection data items of the deformed part of the charging roller that has undergone press-contact deformation increases. Thus, the detection accuracy can be increased. At this time, it is desired that the rotating speed of the charging roller 2 is set 0.3 times to 1.0 times, preferably 0.5 times to 0.7 times the rotating speed of the charging roller during a normal image formation operation. The reason is as follows. When the charging roller is rotated at a speed slower than 0.3 times, the detection time for detecting the pitch of the charging roller is increased, and a voltage is applied to the charging roller during this period. Therefore, abrasion of the drum may be promoted.

<Deformation Restoring Unit for Charging Roller>

The image forming apparatus of this embodiment is provided with a roller deformation restoring unit so as to perform deformation restoring control when press-contact deformation of the charging roller is detected by the deformation determining unit for the charging roller.

Examples of the roller deformation restoring operation may include performing an idling operation or an image formation operation so that the charging roller 2 rotates while being held in press-contact with the photosensitive drum 1. As a method of restoring the roller deformation, it is effective to not only rotate the charging roller 2, but also apply an AC voltage when the charging roller 2 is rotated.

When an AC voltage is applied to the charging roller 2, heat is generated in the charging roller 2 due to discharge, and the rubber characteristics are changed. Thus, an effect of promoting the restoration of the rubber deformation can be expected. When an AC voltage is applied, micro vibration occurs in the charging roller 2 in synchronization with the AC frequency, and thus a phenomenon in which the charging roller 2 is pushed against and separated from the photosensitive drum 1 occurs. With the micro vibration applied to the charging roller 2, an effect of promoting the restoration of the deformation on the charging roller surface can be expected.

When the AC voltage is applied for control of restoring deformation of the charging roller 2, the frequency of the AC voltage may be changed depending on the generation level of the roller deformation, or the frequency may be controlled to be switched between the deformation part and the non-deformation part. When the restoration is promoted by the micro vibration to be applied to the charging roller 2, more effect can be expected as the frequency becomes higher, but the frequency is desired to be limited to a range of 1.1 times to 3.0 times of the frequency of the AC voltage used during the image formation operation. In a case where a frequency higher than this range is used, when the restoring operation time period is increased, the abrasion of the photosensitive drum 1 may be promoted, or another image failure such as smeared images may be caused due to adhesion of a discharge product. In order to avoid those troubles, control of applying a high frequency only in the deformed part of the roller is effective. It is demanded to select, depending on the characteristics of the charging roller, an optimum frequency band in which the effect can be expected. Even with a frequency that is equivalent to or less than the frequency of the AC voltage used in the image formation operation, the deformation can be restored by adjusting the application time period.

In order to avoid troubles, such as promotion of abrasion of the photosensitive drum and smeared images caused by adhesion of discharge production, which are caused by application of an AC voltage with a frequency higher than that during a recording operation, the amplitude (peak voltage) of the AC voltage during the restoring operation is preferred to be set to an AC voltage amplitude that does not cause corona discharge.

The roller deformation restoring operation in this embodiment includes control of switching the restoring operation among a plurality of different patterns depending on the generation level of the roller deformation (i.e. an amount of press-contact deformation to be desired).

For example, when there are three stages of levels 1 to 3 in the deformation generation level to be detected by the deformation determining unit for the charging roller, in a case of level 1 representing a small deformation level, a restoring operation is executed by idly rotating the charging roller 2 (restoring operation level 1). In the case of a small deformation amount, the deformation can be restored merely by idling.

In a case where the deformation generation level is level 2, a restoring operation of applying an AC voltage while idly rotating the charging roller 2 is executed (restoring operation level 2). By applying an AC voltage, micro vibration is applied to the charging roller 2 to enhance the effect of restoring the deformation of the roller.

In a case where the deformation generation level is level 3, while idly rotating the charging roller 2, the AC voltage is applied for a time period set longer than the case of level 2, and further the frequency of the AC voltage to be applied is increased (restoring operation level 3). By increasing the frequency of the AC voltage, micro vibration further occurs in the charging roller 2 to further enhance the effect of restoring the deformation of the roller. Instead of increasing the frequency of the AC voltage, amplitude of the AC voltage may be broadened.

<Results of Experiments>

Next, the results of experiments are described. The experiments were performed with use of the image forming apparatus of this embodiment to perform the operation of detecting and restoring the press-contact deformation of the charging roller.

Experiment 1

In order to confirm the effect of the operation of detecting the amount of current change during energization, which occurred due to the press-contact deformation of the charging roller 2 held in press-contact with the photosensitive drum 1, and the effect of the operation of restoring the deformation, an apparatus obtained by modifying an A4-size type MFP (multi function printer) was used.

The charging roller 2 used for the experiment was an elastic rubber roller having a three-layer configuration including a base layer (elastic layer), a dielectric layer, and a protective layer. The roller had an outer diameter of φ12 and an Asker C hardness of 48±5°.

Figure 5:
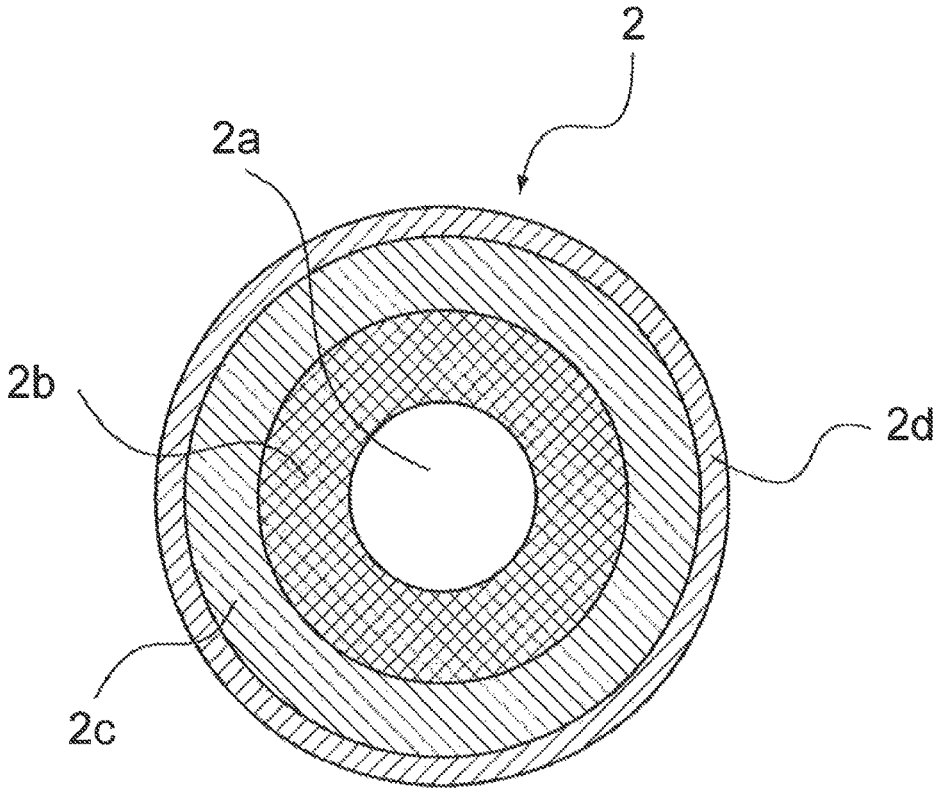
FIG. 5 is an explanatory sectional view of a charging roller.

FIG. 5 is a schematic view of the cross-section of the charging roller 2 used for the experiment. A core metal 2*a* is made of material using SUS. The charging roller 2 includes, in the order from the inner side, a base layer 2*b* made of urethane sponge, a dielectric layer 2*c* containing an acrylic resin as a main component, and a protective layer 2*d* containing a fluorine resin as a main component.

The apparatus used for confirming the effects includes, between a high voltage output portion and a ground, a feedback current amount measurement portion configured to detect the amount of a current flowing between the photosensitive drum 1 and the charging roller 2. The feedback current amount measurement portion measures the feedback current amount flowing in the charging roller 2 in response to application of the voltage. The feedback current value can be read at an interval of 2 msec.

The detection was performed with use of a drum cartridge left under a state in which the charging roller 2 was held in abutment against the photosensitive drum 1 for three days in a low temperature environment (5° C. environment). It had been confirmed even on a halftone image that the drum cartridge had undergone press-contact deformation. As the detection voltage, a DC-AC superimposed voltage was applied to collect the data of the feedback current amount. The AC application voltage was 1.5 kV, the AC frequency was 1,838 Hz, and a DC voltage was −580 V.

The threshold for determination of the generation level of the press-contact deformation was set to a range in which the average of the difference A between the average value T and the current amount peak of the feedback current was from 50 μA to 100 μA.

In actual measurement, a point at which the difference A was 60 μA to 80 μA was determined as the generation level of the press-contact deformation. The interval of the current amount peaks that were determined as the generation level of the press-contact deformation was 120 msec. This matched with the pitch of the outer periphery of the charging roller 2.

After that, as the restoring operation, the idling operation for 30 seconds was performed, after pre-rotation of the photosensitive drum 1 for 5 seconds to be performed in usual image formation, and then the press-contact deformation was detected again. The difference between the average value T and the current amount peak reduced to 40 μA, and no press-contact deformation was detected.

Experiment 2

In Experiment 2, the effects were confirmed with use of the configuration of Experiment 1, assuming that the threshold for determination of the generation level of the press-contact deformation was set to a range in which the average of the difference A between the average value T and the current amount peak was from 100 μA to 150 μA. In actual measurement, a point at which the difference A was 100 μA to 120 μA was determined as the generation level of the press-contact deformation. The interval of the current amount peaks that were determined as the generation level of the press-contact deformation was 120 msec. This matched with the pitch of the outer periphery of the charging roller.

After that, as the restoring operation, the idling operation of the drum for 30 seconds was performed while applying a voltage with an AC frequency of 1,838 Hz and an AC voltage of 1.5 kV, and then the press-contact deformation was detected again. The difference between the average value T and the current amount peak reduced to 70 μA, and no press-contact deformation was detected.

Experiment 3

In Experiment 3, the effects were confirmed with use of the configuration of Experiment 1, assuming that the threshold for determination of the generation level of the press-contact deformation was set to a range in which the average of the difference A between the average value T and the current amount peak was from 150 μA to 200 μA. In actual measurement, a point at which the difference A was 150 μA to 170 μA was determined as the generation level of the press-contact deformation. The interval of the current amount peaks that were determined as the generation level of the press-contact deformation was 120 msec. This matched with the pitch of the outer periphery of the charging roller.

After that, as the restoring operation, the idling operation of the drum for 30 seconds was performed while applying a voltage with an AC frequency of 2,600 Hz and an AC voltage of 1.5 kV, and then the press-contact deformation was detected again. The difference between the average value T and the current amount peak reduced to 70 μA, and no press-contact deformation was detected. As results of the above Experiments 1 to 3, it was found that, with the press-contact deformation detection and the restoring operation, the press-contact deformation was restored, and thus it was confirmed that the detection unit and the restoring operation were effective.

Figure 6:
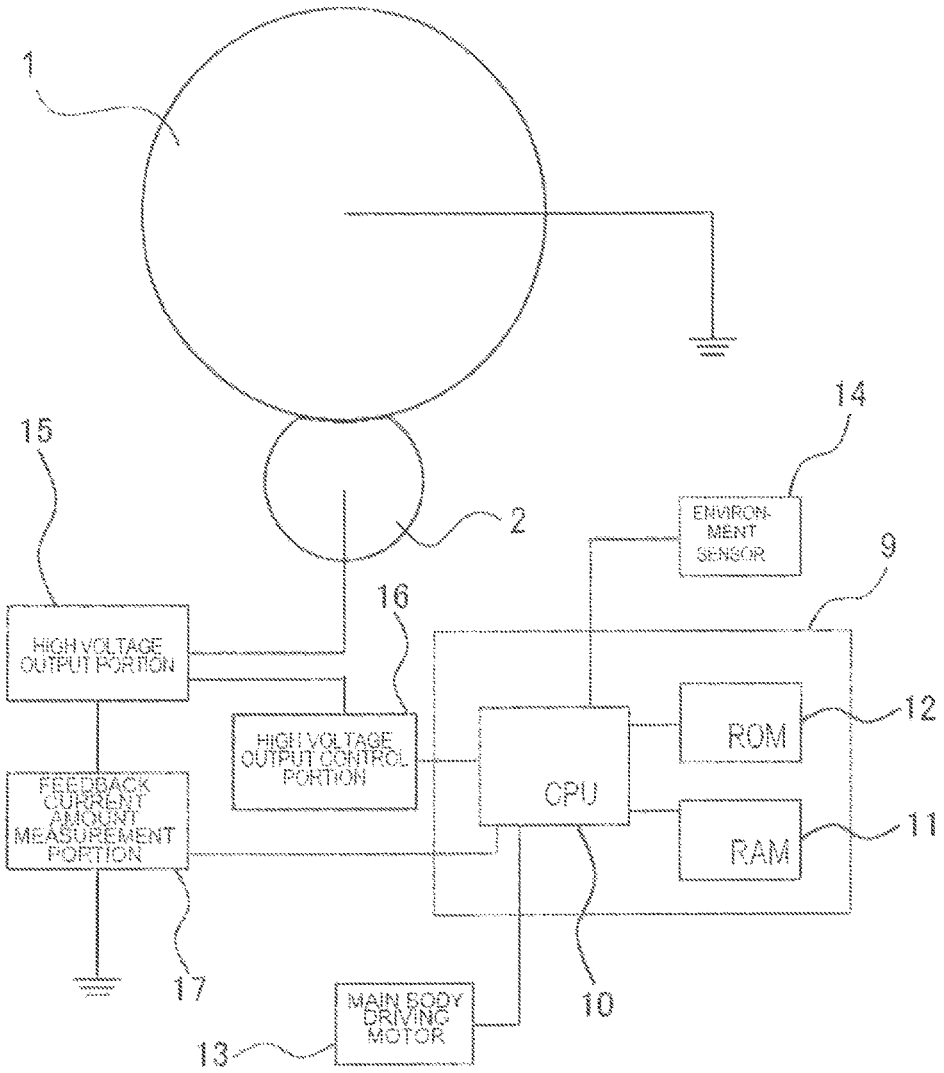
FIG. 6 is a block diagram illustrating a structure of a control portion according to the first embodiment.

FIG. 6 is a block diagram illustrating a structure of a control portion according to this embodiment. The image forming apparatus has a control portion 9 which includes a CPU 10 configured to instruct processing operation of the image forming apparatus, and memories, such as a RAM 11 and a ROM 12, which are configured to store an operating program of the CPU 10 and control data of image forming operation. Moreover, the image forming apparatus has a main body driving motor 13 configured to perform driving for the image forming operation in accordance with the instruction from the CPU 10, an environment sensor 14 configured to detect temperature and humidity, a high voltage output portion 15 configured to output high voltage to the charging roller 2, a high voltage output control portion 16 configured to control the high voltage output portion 15, and a feedback current amount measurement portion 17 configured to measure the feedback current amount flowing in the charging roller 2 to which the voltage is applied. The feedback current amount measurement portion 17 is arranged between the high voltage output portion 15 and the ground, and can measure discharge current flowing from the charging roller 2 to the photosensitive drum 1. This is because the feedback current amount measurement portion 17 detects current (the feedback current) corresponding to current flowing in response to discharge. In this embodiment, the feedback current amount measurement portion 17 measures the discharge current (the feedback current) to be changed in accordance with a gap (an interval) between the charging roller 2 and the photosensitive drum 1. Thereby, a gap due to the press-contact deformation is detected.

<Charging Roller Deformation Determining and Restoring Operation>

Figure 3:
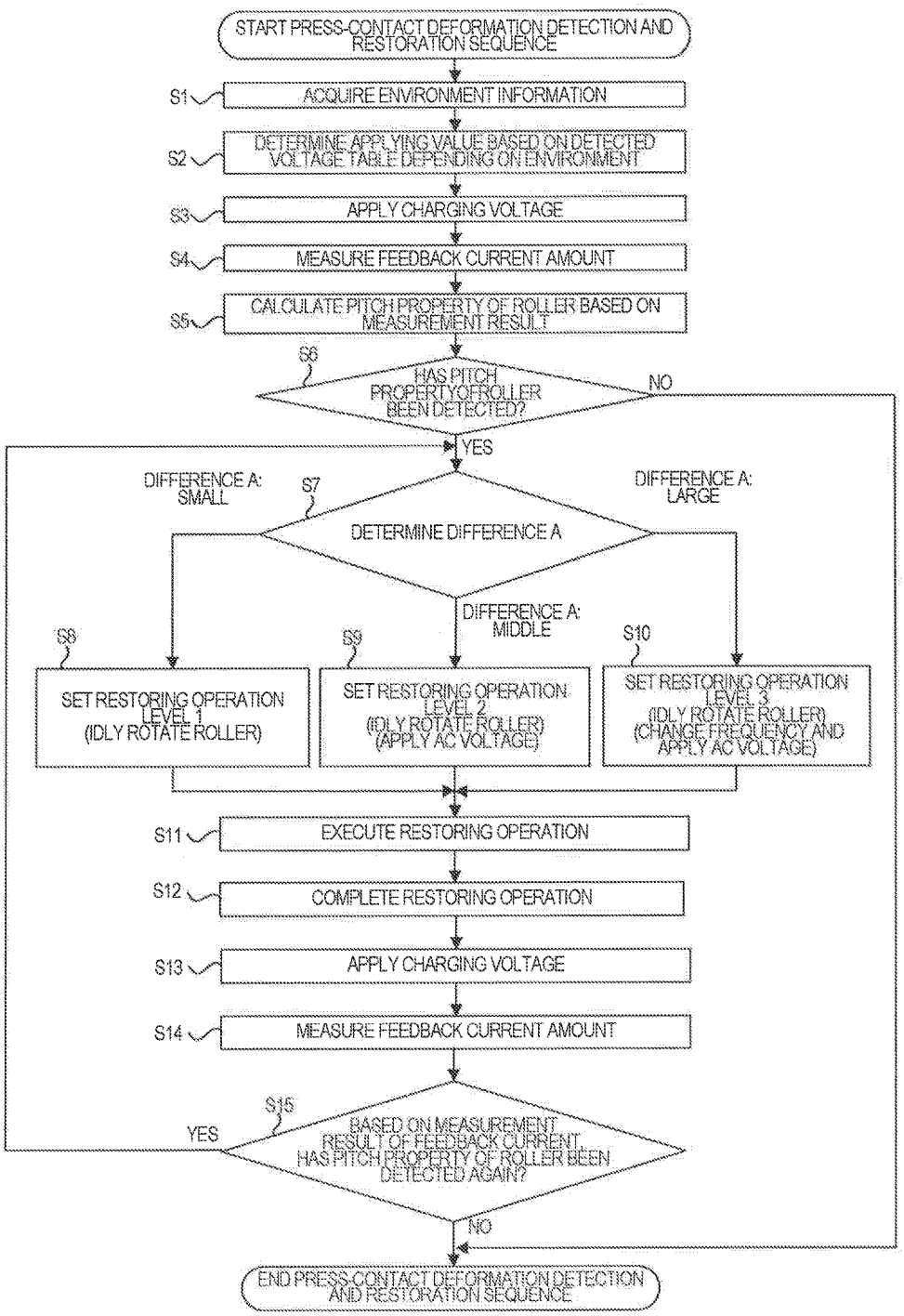
FIG. 3 is a flow chart illustrating an operation of press-contact deformation detection and restoration of a roller.

FIG. 3 is a flow chart illustrating an operation of the CPU 10 in FIG. 6 for determination of the press-contact deformation of the charging roller 2 in the image forming apparatus of this embodiment based on the above results of the experiments, and restoration of the deformation when the deformation is present.

In this embodiment, the detection voltage value is set depending on the apparatus environment. In a case of detecting the press-contact deformation of the charging roller 2, when the power of the apparatus is turned ON, the CPU 10 of the control portion 9 causes the temperature and humidity sensor 14 arranged inside the image forming apparatus to acquire the temperature and humidity information of the apparatus environment (S1). In accordance with the acquired temperature and absolute moisture amount calculated from the temperature and humidity, a charging voltage value (a detection voltage value) to be applied is determined based on a detection voltage table divided as shown in FIG. 4 (S2).

In this embodiment, as shown in FIG. 4, the voltage value for detection of the deformation of the charging roller 2 (high voltage output during detecting) which is illustrated in a lower row, is set to a value of substantially 70% of a voltage value used during image formation (high voltage output during printing) which is illustrated in an upper row. This is because the photosensitive drum 1 is prevented from application of unnecessary high voltage. Although high applied voltage is set during the image formation in order not to generate charging image failure, the press-contact deformation can be detected even when voltage lower than that of the image formation is applied. The detection voltage value in a high temperature and high humidity environment (HH) is set to a value smaller than that in a normal temperature and normal humidity environment (NN). The detection voltage value in a low temperature and low humidity environment (LL) is set to a value higher than that in the normal temperature and normal humidity environment, contrary to the case of the high temperature and high humidity environment. This is for addressing that an electric resistance value of the charging roller 2 is higher as the temperature is lower, and for applying an optimum detection voltage in accordance with the change in electric resistance value of the charging roller 2 depending on the environment. In addition to the cases of high temperature and high humidity and low temperature and low humidity, for example, in the case of a normal temperature and low humidity environment, the value may be appropriately set in accordance with the temperature and humidity state in the apparatus.

After the charging voltage value (the detection voltage value) to be applied is determined, the CPU 10 of the control portion 9 drives the main body driving motor 13 to rotate the photosensitive drum 1 and the charging roller 2, and the determined charging voltage is applied to the charging roller 2 from the high voltage output portion 15 which is controlled by the high voltage output control portion 16 (S3). Then, the feedback current amount measurement portion 17 measures the feedback current flowing between the charging roller 2 and the photosensitive drum 1 (S4). Based on the current value, the CPU 10 calculates the pitch property of the charging roller 2 (S5), determines the present or absence of the press-contact deformation (S6), and determines the deformation level according to the difference A when determining the generation of the press-contact deformation (S7).

When the CPU 10 determines that the charging roller 2 has undergone press-contact deformation, depending on the deformation level, the CPU 10 sets the level of the restoring operation to one of the levels including, for example, restoring level 1 of merely idly rotating (idly rotating for 30 seconds in this embodiment) the charging roller 2 (S8), restoring level 2 of rotating the charging roller and applying an AC voltage (idly rotating for 30 seconds and applying the AC frequency of 1,838 Hz and the AC voltage of 1.5 kV in this embodiment) (S9), and restoring level 3 of rotating the charging roller and applying an AC voltage whose frequency to be applied is set high (idly rotating for 30 seconds and applying the AC frequency of 2,600 Hz and the AC voltage of 1.5 kV in this embodiment) (S10). Then, the set restoring operation is executed (S11), and the restoring operation is completed when executing time period of the set restoring operation (30 seconds in this embodiment) has elapsed (S12).

In this embodiment, after the deformation is detected and the restoring control is performed for the charging roller 2, a feedback current value is detected again to confirm presence or absence of the press-contact deformation of the charging roller. The detection operation is performed with a method similar to the operation performed by the deformation determining unit (S13 to S15). With this operation, when it is determined that no press-contact deformation is generated, the roller deformation detection sequence is completed.

When the restoration of the press-contact deformation of the roller is not recognized, that is, when it is determined in Step S15 that roller deformation is present, the restoring operation is performed again in accordance with the detection level.

In a case where it is determined that, in a restoration effect confirming operation, the press-contact deformation of the roller is present even after the restoring operation is performed a plurality of times (2 or 3 times) by performing the restoring operation repeatedly, it is determined that the press-contact deformation of the roller is not detected, but the stain, scratch (breakage) or the like on the surface of the charging roller is detected. Then, the execution of the restoring operation is interrupted, and alert or the like may be displayed or informed. This is for preventing the promotion of abrasion of the charging roller and the photosensitive drum to be caused by the repetitive restoring operations due to false detection. In the present embodiment, although the charging roller 2 is rotated when performing the restoring operation, it is not absolutely necessary. A press-contact deformed region of the charging roller 2 can be identified by detecting the roller pitch. Therefore, the press-contact deformation can be resolved and restored, for example, by applying an AC frequency of 1,838 Hz and an AC voltage of 1.5 kV to generate micro vibration in the charging roller 2 in a state in which the charging roller 2 is stopped at a position where the press-contact deformed region of the charging roller 2 opposes the photosensitive drum 1, as the restoring operation.

Second Embodiment

Next, an example in which the deformation determining unit for the roller member determines the deformation level of the roller member based on a time period in which the roller member is left in a rotation stop state, the temperature and humidity inside the apparatus, and so on is described.

<Deformation Determining Unit for Roller Member>

In a contact-type roller charging method in which the elastic roller is rotated while being held in press-contact with the photosensitive drum 1, when the elastic roller is left for a long period of time without performing the image forming operation nor being rotated, the part subjected to press-contact is recessed, that is, so-called press-contact deformation occurs. When an image is formed with use of the charging roller 2 that has undergone press-contact deformation, there occurs such a trouble that horizontal streaks and unevenness are generated in the image at a pitch of the outer periphery of the charging roller 2. In the image forming apparatus of this embodiment, when the charging roller 2 is left in a rotation stop state inside the image forming apparatus, the press-contact deformation level of the charging roller 2 is determined based on the leaving state. The image forming apparatus is controlled to set the deformation restoring operation of the charging roller in accordance with the deformation level and execute an optimum restoring operation.

In this embodiment, as the leaving state of the charging roller 2, based on a time period in which the charging roller 2 is left in the rotation stop state, conditions of the left environment, and an electric resistance value of the charging roller 2, the deformation level of the press-contact deformation of the charging roller 2 is determined.

(Temperature and Humidity Inside Apparatus)

The press-contact deformation level of the elastic roller member depends on the temperature and humidity situation which are the conditions of the surrounding environment and left time period when the roller is left as it is. Generally, as the environment has lower temperature, rubber changes its elasticity to be hardened, and hence deformation due to press-contact easily occurs. Even when the humidity is low, the press-contact deformation level significantly influences the output image. This is because, in a low humidity environment, discharge is less liable to occur than in a high humidity environment, and hence the image unevenness between the deformed part and the un-deformed part in a case where the roller has undergone press-contact deformation becomes more conspicuous. In view of such a situation, selecting the roller restoring operation depending on cases divided based on the temperature and humidity is effective to restore the press-contact deformation of the roller economically. The temperature and humidity is detected with use of, for example, an environment sensor installed inside the image forming apparatus. In particular, it is preferred to use the sensor capable of determining the temperature and humidity of an atmosphere inside the image forming apparatus after and before the roller is left as it is.

(Left Time Period)

The press-contact deformation of the roller is more deteriorated as the left time period, that is, a time period in which the roller is held in press-contact with another member becomes longer. Therefore, selecting the roller restoring operation depending on the cases divided based on the left time period is effective to restore the press-contact deformation of the roller economically. It is preferred to measure the left time period with use of a timer inside the main body so that a time period during which the charging roller has been stopped from the end of the recording operation can be stored.

(Resistance Value)

The generation level of the press-contact deformation of the roller also depends on the characteristics of the charging roller. The characteristics of the charging roller include the surface shape, the surface material, the hardness, and the resistance value of the charging roller. In particular, in this embodiment, the level of the press-contact deformation of the roller is determined in focus on the resistance value of the charging roller. The resistance value of the charging roller varies due to the change in surface state caused by repetitive recording operations.

Generally, the charging roller, that has performed repetitive recording and been used a long time, tends to have a higher resistance value across all circumferences of the entire roller than that in an initial charging roller. When the resistance value of the charging roller increases, the detection frequency of the image unevenness due to the press-contact deformation of the roller increases, and hence the level of the press-contact deformation of the roller is deteriorated. The roller having a high resistance value has a low restoring effect of the AC voltage application because the current value flowing through the roller reduces.

Therefore, predicting the generation level of the press-contact deformation of the roller based on an average of the resistance value of all the circumferences of the charging roller and selecting the restoring operation thereafter are effective to restore the press-contact deformation of the roller economically.

As for a roller that has performed repetitive recording of a number of sheets, that is, a roller having a high resistance value, it is preferred to select a restoring operation having a higher restoring effect than that for a roller having a low resistance value. The resistance value of the charging roller can be detected with use of a current circuit inside the board. In a system including a unit configured to detect the feedback current amount that is obtained by feeding back the amount of a current flowing between the charging roller and the photosensitive drum, the resistance value of the charging roller can be detected based on the value of the feedback current amount.

In this embodiment, the press-contact deformation level of the charging roller is predicted based on a combination of, the temperature and humidity situation which are the conditions of the surrounding environment, the left time period, and the charging roller state (resistance value) in a case where the roller member is left as it is, and thus it is controlled so that the press-contact deformation restoring operation thereafter can be appropriately selected. All conditions of the above combination are not required, and the press-contact deformation level of the roller may be predicted based on a combination of any conditions or single condition. Predictability of the press-contact deformation level is increased when considering a combination of the all above conditions, however, the control becomes easier when considering a combination of the few conditions or single condition.

FIG. 7 illustrates an example of a control table determining the press-contact deformation level of the roller by dividing each of the temperature and humidity, the left time period, and the roller resistance value into two regions. In FIG. 7, the press-contact deformation level is predicted based on selection of whether the temperature inside the apparatus falls within a range of T1 or a range of T2 (T1>T2), whether the humidity falls within a range of W1 or a range of W2 (W1>W2), whether the left time period falls within a range of t1 or a range of t2 (t1<t2), and whether the roller resistance value falls within a range of R1 or a range of R2 (R1<R2). For example, when the temperature is T1, the humidity is W2, the left time period is t2, and the resistance value is R1, the deformation level is determined as A. Similarly, for example, when the temperature is T2, the humidity is W1, the left time period is t2, and the resistance value is R2, the deformation level is determined as B, and when the temperature is T2, the humidity is W2, the left time period is t2, and the resistance value is R2, the deformation level is determined as C.

For example, when the temperature falls within the range of T1 and the humidity falls within the range of W1, the temperature and humidity is high. Therefore, the roller deformation is less liable to occur, and even when the roller deformation occurs, the roller is easily restored. Therefore, regardless of the left time period and the resistance value, this case is determined as a level at which the restoring operation is not performed.

The deformation level increases in the order of A<B<C, and the restoration becomes more difficult as the level increases in the order of the deformation levels A, B, and C when the same restoring operation is executed.

It is desired that each of the temperature, the humidity, the left time period, and the resistance value of the charging roller be divided into cases of a plurality of stages, that is, at least two stages. The resistance value of the charging roller tends to increase as the number of sheets subjected to recording increases, and hence instead of the charging roller resistance value calculated based on the amount of the feedback current flowing between the charging roller and the photosensitive drum, the cases may be divided based on the number of sheets subjected to recording.

When the cases are divided based on the resistance value of the charging roller, it is preferred to divide the resistance value into 2 to 5 sections from an initial resistance value R(a) at the start of use to a terminal resistance value R(b) (R(a)<R(b)) immediately before the end of life, and the roller deformation level be determined based on which sectioned range the resistance value belongs to. When the resistance value is divided into more than 5 sections, the selection of the restoring operation becomes complicated. When the resistance value is divided into less than 2 sections, fluctuations in resistance of the charging roller influenced by the number of sheets subjected to recording cannot be suppressed, and hence it is difficult to predict an accurate deformation level.

When the cases are divided based on the number of sheets subjected to recording, it is preferred to divide the cases into a plurality of stages, for example, five stages, that is, at least two stages, in accordance with the endurance number of sheets of the drum cartridge.

In this embodiment, the deformation level of the roller is determined based on the temperature and humidity inside the apparatus, the left time period, and the roller resistance value, but the deformation level of the roller may be determined based on one of the temperature and humidity, the left time period, and the roller resistance value or a combination thereof.

<Results of Experiments>

Next, the results of experiments are described. The experiments were performed with use of the image forming apparatus of this embodiment so as to perform the operation of determining and restoring the press-contact deformation of the charging roller.

Experiment 1

In order to confirm the effect of detection of current change amount, when applying current, which is associated with the press-contact deformation of the charging roller 2 held in press-contact with the photosensitive drum 1, and the effect of the operation of restoring, an apparatus obtained by modifying an A4-size type MFP (multi function printer) was used.

The charging roller 2 used for the experiment was an elastic rubber roller having a three-layer configuration including a base layer (elastic layer), a dielectric layer, and a protective layer. The roller had an outer diameter of φ12 and an Asker C hardness of 48±5°.

The relationship between the restoring operation and the conditions in a case where the charging roller was left inside the image forming apparatus in a stop state was divided into cases as shown in FIG. 9.

The temperature in the environment in which the apparatus was installed was set to have two conditions of 25° C. or more and less than 25° C. The humidity was set to have two conditions of 50% or more and less than 50%. The left time period was set to have two conditions of less than 24 hours and 24 hours or more. The charging roller resistance value was set to have two conditions of less than $5.0\times10^5\Omega$ and $5.0\times10^5\Omega$ or more.

The temperature and humidity are detected with use of an environment sensor provided inside the main body, and all of the temperature and humidity situations before leaving the main body, while the main body is left, and at the time of restart can be recorded.

As the left time period, a time period from the recording operation end until the recording operation is prepared again is recorded by a timer provided inside the main body.

The cases were divided based on the above-mentioned conditions, and when the restoring operation was necessary, one of the press-contact deformation levels A, B, and C was determined. Then, one of the restoring operation levels A, B, and C was set in accordance with each press-contact deformation level, and the above-mentioned restoring operation was executed.

In each condition, the selection of the restoring operation, the image level when no restoring operation was performed, and the image level after the restoring operation was performed were confirmed. Under those conditions, it was confirmed that the prediction and the selection of the restoring operation were normally performed, and no press-contact deformation was generated in the charging roller after the restoring operation.

Experiment 2

In Experiment 2, with use of the configuration of Experiment 1, the setting of the conditions for the determination level of the press-contact deformation of the charging roller was changed. Then, the restoring operation was set in accordance therewith and the effects were confirmed. FIGS. 10A and 10B illustrate the setting tables for the conditions.

The temperature in the environment in which the apparatus was installed was set to have three conditions of 25° C.

or more, 15° C. or more and less than 25° C., and less than 15° C. The humidity was set to have two conditions of 50% or more and less than 50%. The left time period was set to have three conditions of less than 24 hours, 24 hours or more and less than 48 hours, and 48 hours or more. The charging roller resistance value was set to have two conditions of less than $5.0\times10^5\Omega$ and $5.0\times10^5\Omega$ or more.

The cases were divided based on the above-mentioned conditions, and when the restoring operation was necessary, one of the press-contact deformation levels A, B, and C was determined. Then, one of the restoring operation levels A, B, and C was set in accordance with each press-contact deformation level, and the above-mentioned restoring operation was executed.

In each condition, the selection of the restoring operation, the image level when no restoring operation was performed, and the image level after the restoring operation was performed were confirmed. Under those conditions, it was confirmed that the prediction and the selection of the restoring operation were normally performed, and no press-contact deformation was generated in the charging roller after the restoring operation.

Experiment 3

In Experiment 3, with use of the configuration of Experiment 1, the setting of the conditions for the determination level of the press-contact deformation of the charging roller was changed. Then, the restoring operation was set in accordance therewith and the effects were confirmed. FIG. 11 illustrates the setting table for the conditions.

The temperature in the environment in which the apparatus was installed was set to have two conditions of 25° C. or more and less than 25° C. The humidity was set to have two conditions of 50% or more and less than 50%. The left time period was set to have two conditions of less than 24 hours and 24 hours or more. The state of the charging roller was divided in cases based on, instead of the charging roller resistance value, the number of sheets subjected to recording (endurance number of sheets). The number of sheets subjected to recording was set to have two conditions of less than 30,000 sheets and 30,000 sheets or more.

The cases were divided based on the above-mentioned conditions, and when the restoring operation was necessary, one of the press-contact deformation levels A, B, and C was determined. Then, one of the restoring operation levels A, B, and C was set in accordance with each press-contact deformation level, and the restoring operation was executed.

In each condition, the selection of the restoring operation, the image level when no restoring operation was performed, and the image level after the restoring operation was performed were confirmed. Under those conditions, it was confirmed that the prediction and the selection of the restoring operation were normally performed, and no press-contact deformation was generated in the charging roller after the restoring operation.

<Press-Contact Deformation Restoring Unit for Roller Member>

The image forming apparatus of this embodiment is provided with a roller deformation restoring unit similar to that of the first embodiment so as to perform deformation restoring control when press-contact deformation of the charging roller is determined by the deformation determining unit for the charging roller based on the above results of the experiments. When the press-contact deformation level of the charging roller is determined by the roller deformation determining unit, the restoring unit performs the deformation restoring control of the roller in accordance with the press-contact deformation level.

Figure 12:
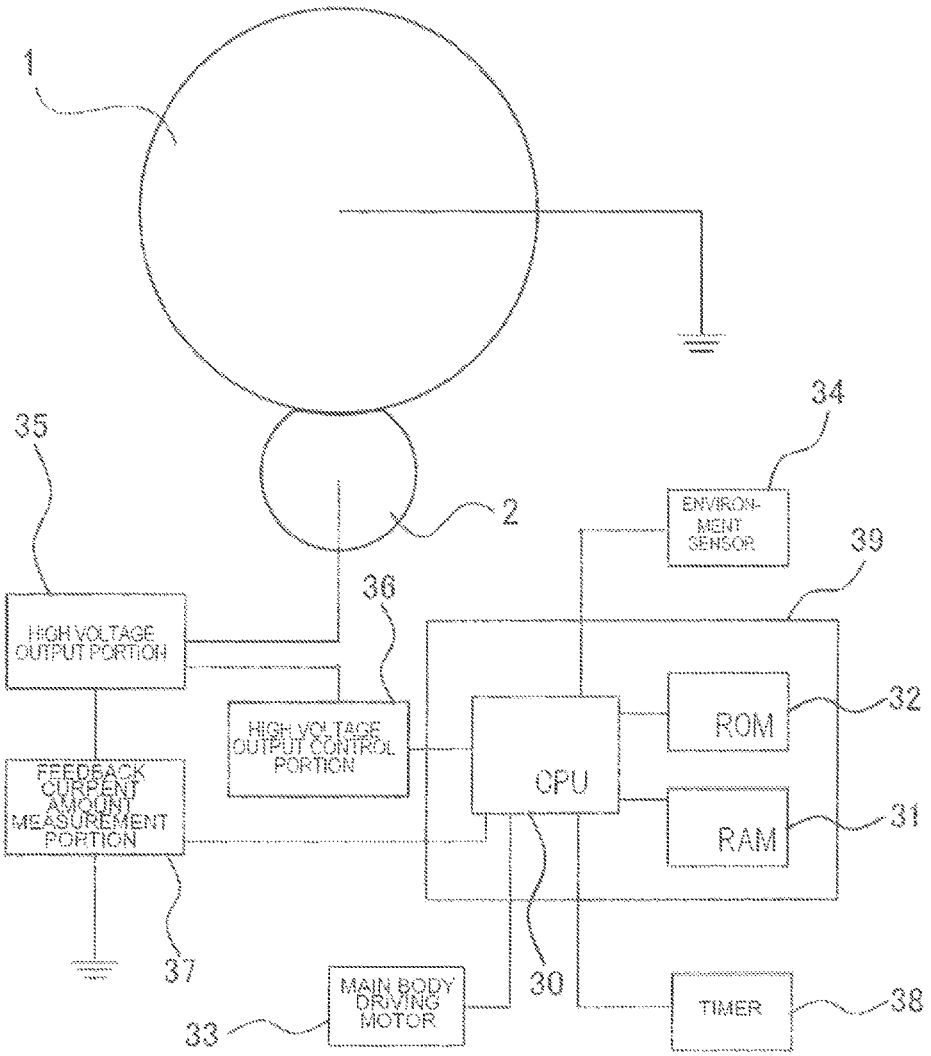
FIG. 12 is a block diagram illustrating a structure of a control portion according to the second embodiment.

FIG. 12 is a block diagram illustrating a structure of a control portion according to this embodiment. The image forming apparatus has a control portion 39 which includes a CPU 30 configured to instruct processing operation of the image forming apparatus, and memories, such as a RAM 31 and a ROM 32, which are configured to store an operating program of the CPU 30 and control data of image forming operation. Moreover, the image forming apparatus has a main body driving motor 33 configured to perform driving for the image forming operation in accordance with the instruction from the CPU 30, a timer 38 configured to obtain a left time period, in which the charging roller 2 is left in a rotation stop state, by measuring a time period in which the main body driving motor 33 has stopped, an environment sensor 34 configured to detect temperature and humidity, a high voltage output portion 35 configured to output high voltage to the charging roller 2, a high voltage output control portion 36 configured to control the high voltage output portion 35, and a feedback current amount measurement portion 37 configured to measure the feedback current amount flowing in the charging roller 2 in response to application of the voltage. The feedback current amount measurement portion 37 is arranged between the high voltage output portion 35 and the ground, and can measure discharge current flowing from the charging roller 2 to the photosensitive drum 1. This is because the feedback current amount measurement portion 37 detects current (the feedback current) corresponding to current flowing in response to discharge. In this embodiment, unlike in the above mentioned first embodiment, the discharge current (the feedback current) to be generated between the charging roller 2 and the photosensitive drum 1 is measured. Thereby, the roller resistance value is detected and its average value is calculated.

Figure 8:
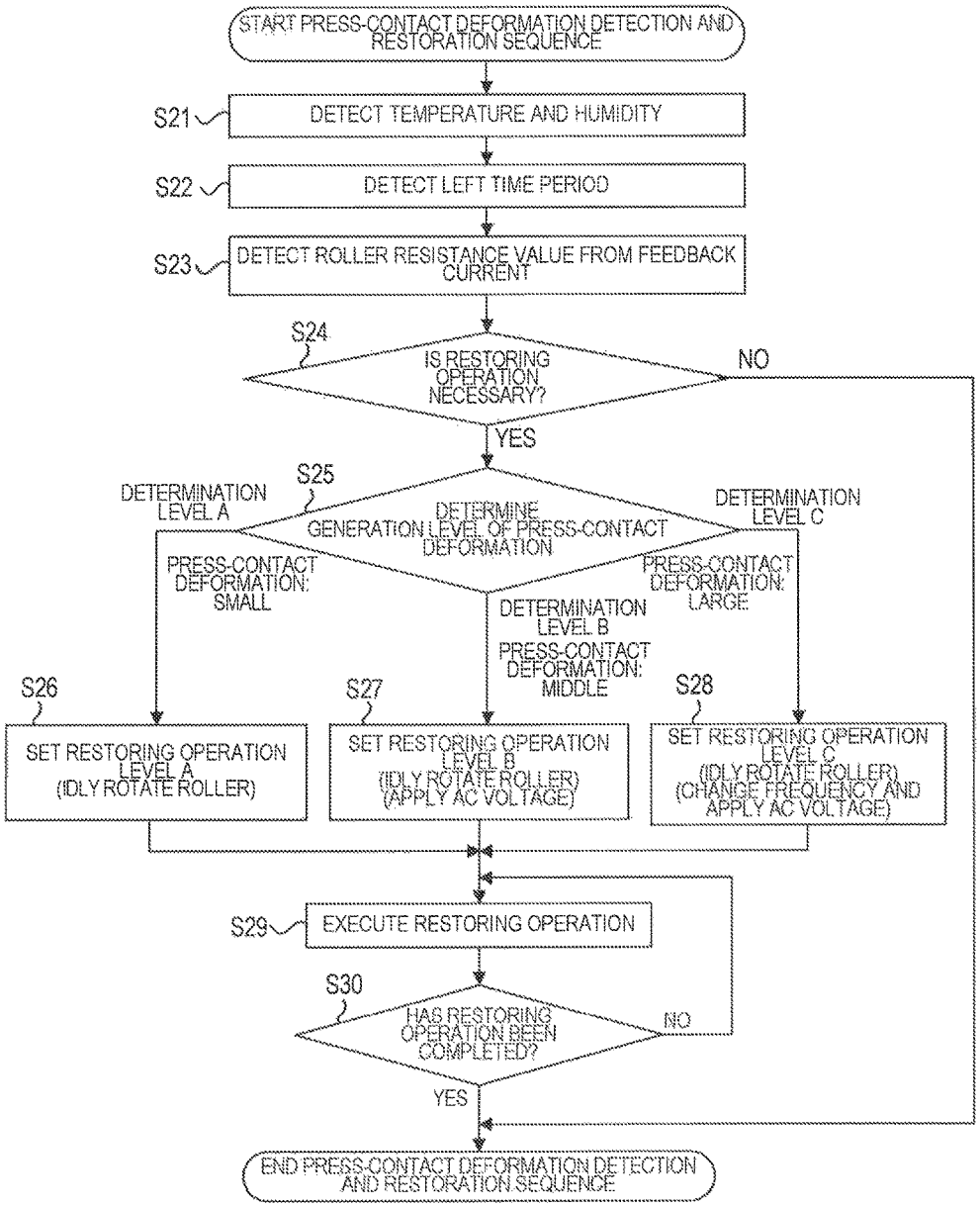
FIG. 8 is a flow chart illustrating an operation of press-contact deformation determination and restoration of a roller.

FIG. 8 is a flow chart illustrating an operation of the CPU 30 in FIG. 12 for determination of the press-contact deformation of the charging roller 2 in the image forming apparatus of this embodiment, and restoration of the deformation when the deformation is present.

When the image forming apparatus is turned ON, the press-contact deformation determination and restoration sequence for the roller member is executed. Specifically, the CPU 30 of the control portion 39 causes the environment sensor 34 arranged in the apparatus to detect the temperature and humidity (S21), and causes the timer 38 to detect the time period in which the charging roller 2 is left in a stop state (S22). Further, in this embodiment, the feedback current amount measurement portion 37 detects the average value of the roller resistance value based on the feedback current amount of the charging roller 2 (S23). Based on those detection values, the press-contact deformation level of the charging roller 2 is determined in accordance with the control table stored in the ROM 32 (see FIG. 9).

When the CPU 30 determines that the deformation of the charging roller 2 does not require a restoring operation, the restoring sequence is completed (S24). On the other hand, when it is determined that the deformation is at a level that requires a restoring operation, the restoring level is set in accordance with the deformation level (S25).

For example, when there are three stages of levels A, B, and C in the deformation determination level detected by the deformation determining unit for the charging roller, the CPU 30 of the control portion 39 drives the main body driving motor 33 first, in a case of level A representing a small deformation level, a restoring operation is executed by idly rotating the charging roller (idly rotating for 30 seconds in this embodiment) (restoring operation level A) (S26). In the case of a small amount of press-contact deformation, the press-contact deformation can be resolve and restored merely by idling.

In a case where the deformation generation level is level B, a restoring operation of applying an AC voltage from the high voltage output portion 35 which is controlled by the high voltage output control portion 36 while idly rotating the charging roller 2 is executed (idly rotating for 30 seconds and applying the AC frequency of 1,838 Hz and the AC voltage of 1.5 kV in this embodiment) (restoring operation level B) (S27). By applying an AC voltage, micro vibration is applied to the charging roller 2 to enhance the effect of restoring the deformation of the roller.

In a case where the deformation generation level is level C, while idly rotating the charging roller 2, the AC voltage is applied for a time period set longer than the case of level B, and further the frequency of the AC voltage to be applied is increased (idly rotating for 30 seconds and applying the AC frequency of 2,600 Hz and the AC voltage of 1.5 kV in this embodiment) (restoring operation level C) (S28). By increasing the frequency of the AC voltage, micro vibration further occurs in the charging roller 2 to further enhance the effect of restoring the deformation of the roller.

Then, the CPU 30 executes the set restoring operation (S29), and then the restoring operation is completed when the set time period of the idle rotation has elapsed (S30).

Another Embodiment

In the above-mentioned embodiments, the charging roller configured to charge the photosensitive drum is exemplified as a roller member in which the press-contact deformation is detected. However, the roller member that may undergo press-contact deformation is not limited to the charging roller, and press-contact deformation may occur also in, for example, the transfer roller 5 or a cleaning roller (not shown) to be used as a cleaning member for the charging roller or the photosensitive drum. Also in those roller members, the deformation of the roller member may be detected based on the change in current amount during energization in response to voltage application, a time period in which the roller member is left in a rotation stop state, and the like. Therefore, even in a roller member other than the charging roller, such as the transfer roller, the press-contact deformation may be similarly detected and restored by the above-mentioned configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-190748, filed Aug. 31, 2012, No. 2012-239187, filed Oct. 30, 2012, No. 2013-115607, filed May 31, 2013 and No. 2013-173737, filed Aug. 23, 2013 which are hereby incorporated by reference herein in their entirety.

What is claimed is:

1. An image forming apparatus comprising:

a rotatable roller member configured to be held in press-contact with an image bearing member; and a controller determining a deformation state of the roller member, wherein the controller determines the deformation state of the roller member in a state where a rotating speed of the roller member is slower than a rotating speed of the roller member during image formation.

2. An image forming apparatus according to claim 1, wherein the roller member is any one of a charging roller configured to charge the image bearing member, a transfer roller configured to transfer a toner image formed on the image bearing member onto a sheet, and a cleaning roller configured to clean a member to be cleaned.

3. An image forming apparatus according to claim 1, wherein the controller restores deformation of the roller member based on the deformation state.

4. An image forming apparatus according to claim 1, wherein the controller determines the deformation state of the roller member based on a value of a current flowing between the roller member and the image bearing member in response to application of a potential difference between the roller member which is rotating and the image bearing member.

5. An image forming apparatus according to claim 4, wherein the controller determines whether the value of the current falls within a predetermined range, and wherein the predetermined range has a plurality of ranges set in accordance with a deformation state of the roller member.

6. An image forming apparatus according to claim 4, wherein the potential difference applied by the controller is smaller than a potential difference between the roller member and the image bearing member to be applied during image formation.

7. An image forming apparatus comprising:

a rotatable roller member configured to be held in press-contact with an image bearing member; and a controller determining a deformation state of the roller member, wherein the controller restores deformation of the roller member and applies an AC voltage to the roller member so as to apply one of a first AC voltage and a second AC voltage different from the first AC voltage according to the deformation state of the roller member, with both first and second AC voltages being non-zero voltages.

8. An image forming apparatus according to claim 7, wherein, when a deformation amount of the roller member determined by the controller is large, the controller applies the first AC voltage having a frequency higher than a frequency of the second AC voltage to be applied when the deformation amount is small.

9. An image forming apparatus according to claim 7, wherein, when a deformation amount of the roller member determined by the controller is large, the controller applies the first AC voltage having an amplitude larger than an amplitude of the second AC voltage to be applied when the deformation amount is small.

10. An image forming apparatus according to claim 7, wherein the controller applies a potential difference between the roller member which is rotating and the image bearing member, detects a value of a current flowing between the roller member and the image bearing member, and determines the deformation state of the roller member based on a result of the detection.

11. An image forming apparatus according to claim 10, wherein the controller detects the deformation state of the roller member when the value of the current detected in a rotating period of the roller member falls within a predetermined range, and the predetermined range has a plurality of ranges set in accordance with the deformation state of the roller member.

12. An image forming apparatus according to claim 10, wherein a rotating speed of the roller member when the controller determines the deformation state of the roller member is slower than a rotating speed of the roller member during image formation.

13. An image forming apparatus according to claim 7, wherein the controller determines the deformation state of the roller member based on at least one of an environment while the roller member is being left in a rotation stop state, and a number of sheets subjected to recording on each of which an image is formed by the image bearing member with use of the roller member.

14. An image forming apparatus comprising:

a rotatable roller member configured to be held in press-contact with an image bearing member;

a detecting unit detecting a current value to flow through the roller member; and a controller determines whether or not to perform idle rotation, in which the roller member rotates in a state of press-contacting with the image bearing member, based on the current value detected by the detecting unit when applying potential difference between the roller member and the image bearing member while causing the roller member to rotate at a lower rotational speed than that during image formation.

15. An image forming apparatus according to claim 14, wherein the controller performs the idle rotation when a difference between the current value and an average of the current value is equal to or higher than a predetermined value.

* * * * *